US007909918B2

(12) United States Patent
Bias et al.

(10) Patent No.: US 7,909,918 B2
(45) Date of Patent: Mar. 22, 2011

(54) AIR FILTRATION SYSTEM

(75) Inventors: Larry S. Bias, Flint, TX (US); Kristin Lyn Schaefer, Tyler, TX (US); Shannon L. Smith, Flint, TX (US); John Mark Hagan, Tyler, TX (US); Mark David Woodruff, Tyler, TX (US); Daniel Joseph Mitchell, Gilmer, TX (US); Cassius J. Mullen, Whitehouse, TX (US); Timothy H. Cauley, Whitehouse, TX (US); Robert Beasley, Whitehouse, TX (US)

(73) Assignee: Trane International, Inc., Piscataway, NJ (US)

( * ) Notice: Subject to any disclaimer, the term of this patent is extended or adjusted under 35 U.S.C. 154(b) by 420 days.

(21) Appl. No.: 11/893,159

(22) Filed: Aug. 15, 2007

(65) Prior Publication Data

US 2009/0044703 A1 Feb. 19, 2009

(51) Int. Cl.
*B03C 3/68* (2006.01)

(52) U.S. Cl. ..... 96/26; 96/30; 96/39; 96/64; 96/77; 96/81; 96/94

(58) Field of Classification Search ..... 96/15, 29, 96/30, 39–41, 77, 80–82, 88, 94, 96, 97, 96/25, 26, 60, 62, 64
See application file for complete search history.

(56) References Cited

U.S. PATENT DOCUMENTS

| | | | | |
|---|---|---|---|---|
| 3,222,848 | A | 12/1965 | Koble, Jr. | |
| 3,504,482 | A | 4/1970 | Goettl | |
| 3,513,634 | A | 5/1970 | Angonese et al. | |
| 3,626,668 | A | 12/1971 | Cardiff | |
| 3,654,747 | A | 4/1972 | Remick | |
| 5,403,383 | A | 4/1995 | Jaisinghani | |
| 5,578,112 | A * | 11/1996 | Krause | 96/24 |
| 6,056,808 | A * | 5/2000 | Krause | 96/24 |
| 6,387,164 | B1 | 5/2002 | Cheng | |
| 6,749,669 | B1 | 6/2004 | Griffiths et al. | |
| 7,597,749 | B2 * | 10/2009 | Paterson et al. | 96/39 |
| 2006/0016335 | A1 | 1/2006 | Cox et al. | |
| 2006/0018811 | A1 * | 1/2006 | Taylor et al. | 422/186.04 |
| 2007/0039462 | A1 | 2/2007 | Helt et al. | |
| 2007/0039472 | A1 | 2/2007 | Bias et al. | |

FOREIGN PATENT DOCUMENTS

WO WO 2007/021854 A1 2/2007

* cited by examiner

*Primary Examiner* — Richard L Chiesa
(74) *Attorney, Agent, or Firm* — Conley Rose, P.C.; J. Robert Brown, Jr.

(57) ABSTRACT

An intense field dielectric air filtration system includes a perimeter frame for wall or ceiling mounting at the inlet of a return air duct for an air conditioning apparatus. A door including a grille disposed thereon is mounted for movement on the frame between working and non-working positions for access to an air filter unit, a pre-filter unit and an intense field particle charging unit. Contacts on the filter unit and the field charging unit engage cooperating contacts on an enclosure mounted on the frame when the door is closed to supply electrical power. An interlock is provided to interrupt power when the door is moved to an open position or the grille is removed. A control system disposed in the enclosure includes user control features accessible when the door is in an open position. An alternate embodiment includes a support frame for positioning the filtration system in ductwork or the like other than a return air inlet.

33 Claims, 17 Drawing Sheets

AIR FILTRATION SYSTEM

BACKGROUND OF THE INVENTION

The filtration of air in interior or indoor spaces has become important to maintain and improve human health and to keep interior spaces and furnishings more clean than heretofore obtainable. An effective type of electrically energized air filtration system is known as an Intense Field Dielectric (IFD) filtration system. U.S. Pat. No. 6,749,669 issued Jun. 15, 2004 to Griffiths et al is directed to an IFD type filtration system. U.S. Patent Application Publication No. US 2007/0039472 A1, published Feb. 22, 2007 by Bias, et al. and assigned to the assignee of the present invention discloses and claims several improvements in IFD type filtration systems. U.S. patent application Ser. No. 11/516,263 filed Sep. 6, 2006, by Woodruff, et al. and also assigned to the assignee of the present invention discloses and claims additional improvements in IFD air filtration systems. The above-referenced patent, patent application publication and pending patent application are each incorporated herein by reference.

Additional improvements have been sought in IFD type air filtration systems including the need to provide a system which can be mounted on an interior wall or ceiling at the inlet to a return air duct for an air conditioning apparatus which is circulating air to an enclosed space. Remotely locating an IFD air filtration system with respect to the air conditioning apparatus with which it is associated presents certain problems in mounting the system, providing certain control features and providing suitable power to the system. By providing an IFD air filtration system which can be mounted remote from air conditioning apparatus, greater flexibility in providing an overall efficient and desirable air conditioning system is obtained and it is to these ends that the present invention has been developed.

SUMMARY OF THE INVENTION

The present invention provides an improved air filtration system, particularly a system of the so-called Intense Field Dielectric (IFD) type. In particular, the invention provides an IFD type air filtration system which is adapted for mounting remote from air conditioning apparatus with which the filtration system is associated. More particularly, the invention provides an air filtration system which is adapted to be mounted at the inlet to a return air duct leading to the air conditioning system or apparatus with which the filter is associated.

In accordance with one important aspect of the present invention, an air filtration system is provided which includes a chassis or frame and a door hinged to the frame and comprising an air inlet grille, the door supporting certain components of the air filtration system including a field charging unit and a main, electrically charged, air filter unit which removes particulates and the like which have received an electrical charge from the field charging unit. A so-called prefilter unit may or may not be disposed on the door. The above-mentioned components are conveniently supported on the grille or door and at least the pre-filter unit, if used, and the main filter unit are easily removed from the grille or door for cleaning, repair or replacement.

In accordance with another aspect of the present invention an IFD type air filtration system is provided which includes a control system enclosure mounted on a frame which is adapted for mounting on a wall or ceiling and supported by structural members of the wall or ceiling. The control system is electrically connected to a field charging unit and a main filter unit when the grille or door is in a closed or working position with respect to the chassis or frame and the control system is disconnected from the field charging unit and the main filter unit when the door or grille is moved to an open non working position. The control system and an enclosure therefor includes contact elements which engage corresponding contact elements on the field charging unit and the main filter unit when the grille or door is in the closed position.

Several features facilitate servicing the filtration system of the invention including a conveniently actuatable latch for latching the main filter unit in its working position, an arrangement to assure that the main filter unit is correctly positioned and supported on the system, an arrangement of hinges and latches which facilitate moving the grille or door between open and closed positions and removal of the grille or door from the frame. A control box or enclosure for the filtration system is mounted on the system frame or chassis and includes conveniently positioned human actuatable controls and indicators, as well as other elements which will be appreciated by those skilled in the art.

Still further in accordance with the invention, an improved arrangement of electrical contact elements is provided wherein the contact elements are supported by the system control box or enclosure for engagement with components which require electrical power for operation.

The present invention still further provides an air filtration system which includes an improved interlock, comprising a control feature which de-energizes the electrically operated filter components when the grille or door is moved from a closed working position to an open non working position. A user interface or control panel is advantageously mounted on the control box or enclosure and which is easily accessible by a user of the air filtration system upon moving the grille or door to its open position, although the system may be started and stopped by actuating a push button on the face of the door without moving the door to an open position.

The invention yet further provides an air filtration system adapted for interpositioning in a duct or cabinet of an air conditioning system and which enjoys many of the advantages of the embodiment of the system which is adapted for mounting remote from an air conditioning apparatus.

Certain features of the invention have been described generally hereinabove and those skilled in the art will recognize the advantages and superior features of the invention heretofore described as well as other important aspects thereof, upon reading the detailed description which follows in conjunction with the drawings.

DETAILED DESCRIPTION OF THE PREFERRED EMBODIMENTS

Figure 1:
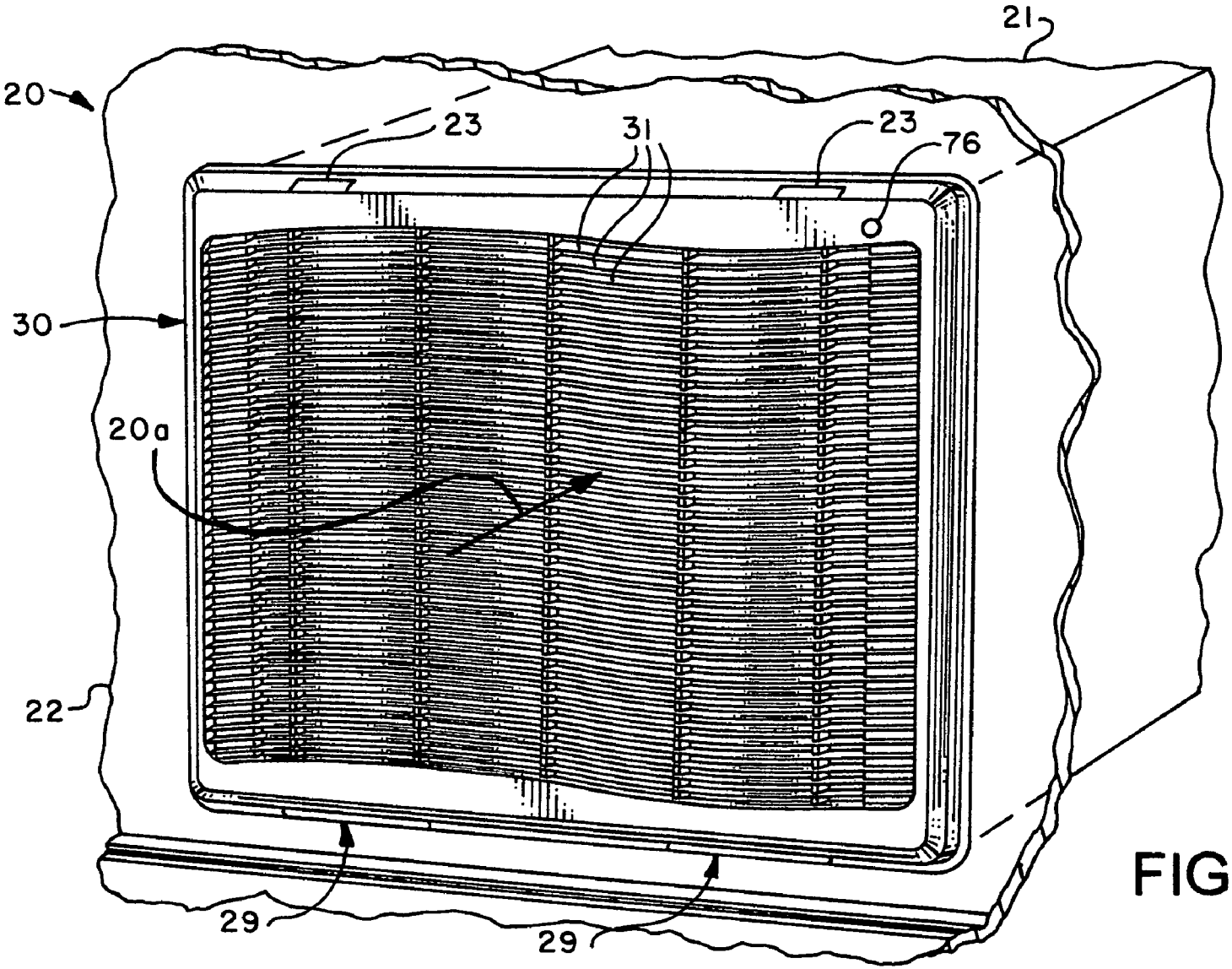
FIG. 1 is a perspective view of an air filtration system in accordance with the invention mounted at the inlet of a return air duct for an air conditioning apparatus.

In the description which follows like parts are marked throughout the specification and drawings with the same reference numerals, respectively. Certain features of the invention may be shown in somewhat generalized or schematic form in the interest of clarity and conciseness.

Figure 2:
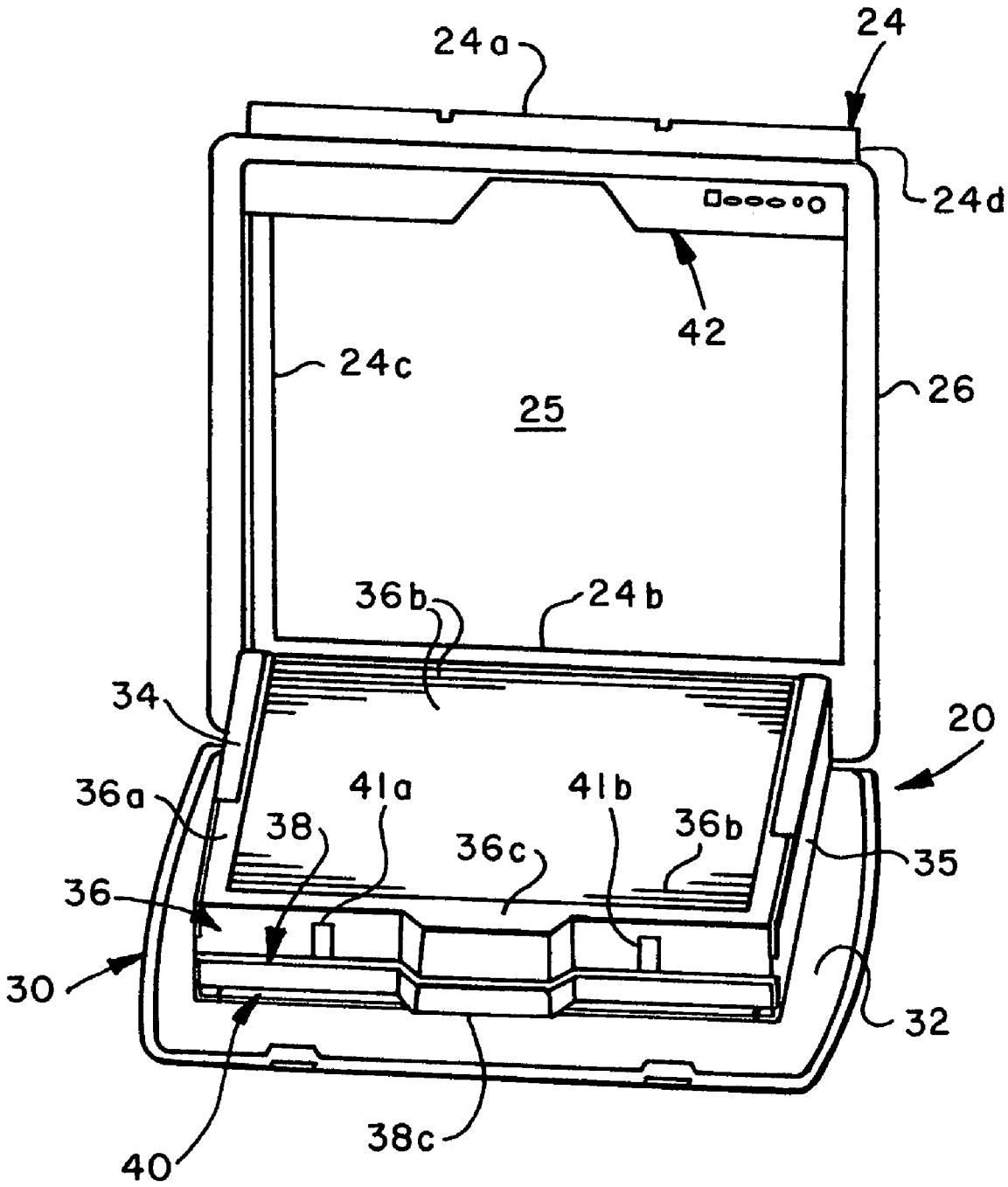
FIG. 2 is a perspective view of the filtration system showing FIG. 1 in a so called open position of a door or grille of the system.

Referring to FIGS. 1 and 2, there is illustrated an improved air filtration system in accordance with the invention and generally designated by the numeral 20. The air filtration system 20 is adapted to mount on a wall or ceiling including, for example, a vertical wall 22, FIG. 1, whereby a suitable opening is provided in the wall for receiving a chassis or frame of the system and generally designated by the numeral 24 in FIGS. 2 and 3. Those skilled in the art will recognize that the filtration system 20 may also be mounted in other positions including in a ceiling or a non-vertical wall or a panel or within cabinetry or the like, for example.

Figure 3:
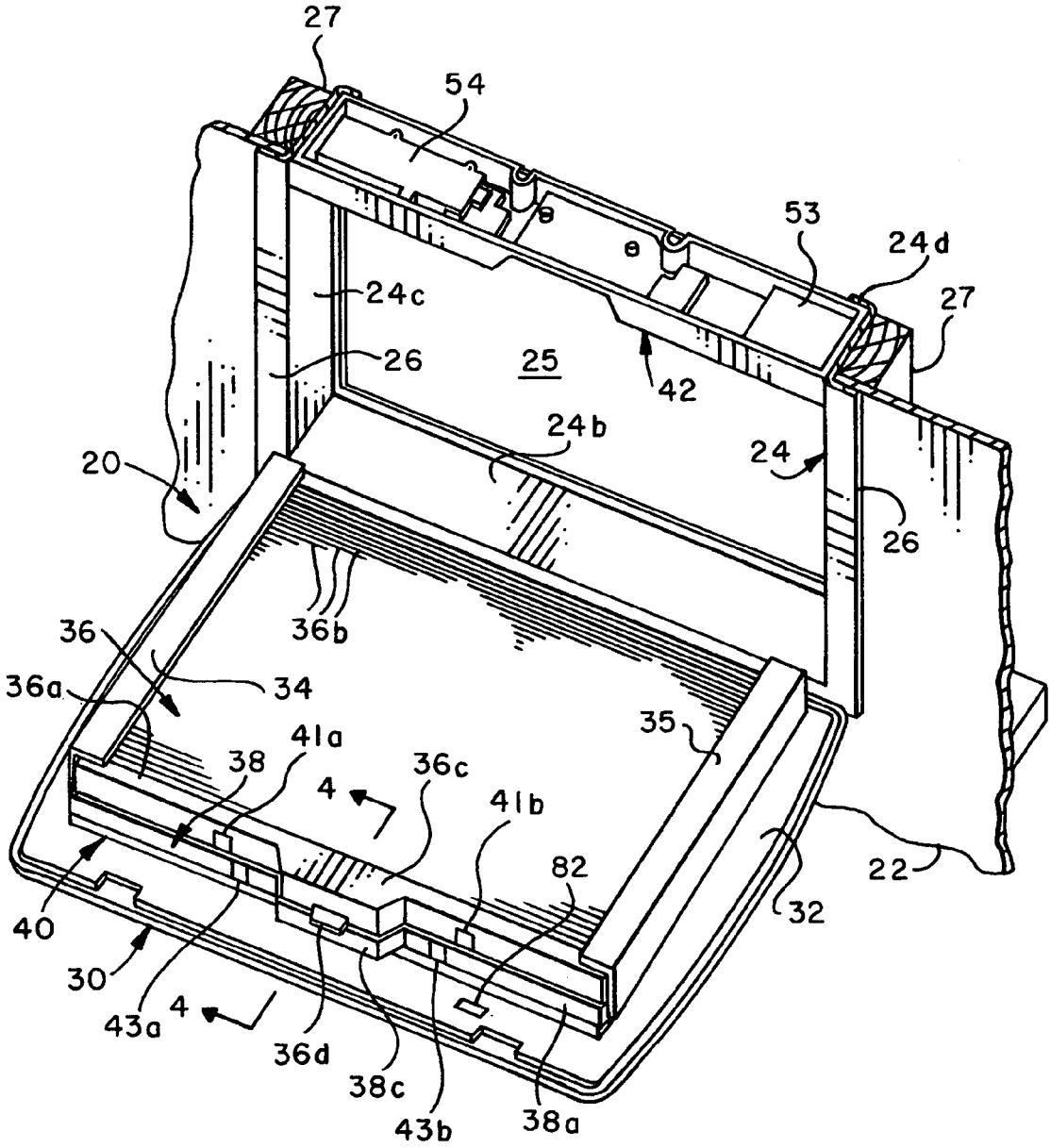
FIG. 3 is perspective view similar to FIG. 2 illustrating additional components of the filtration system.
Figure 4:
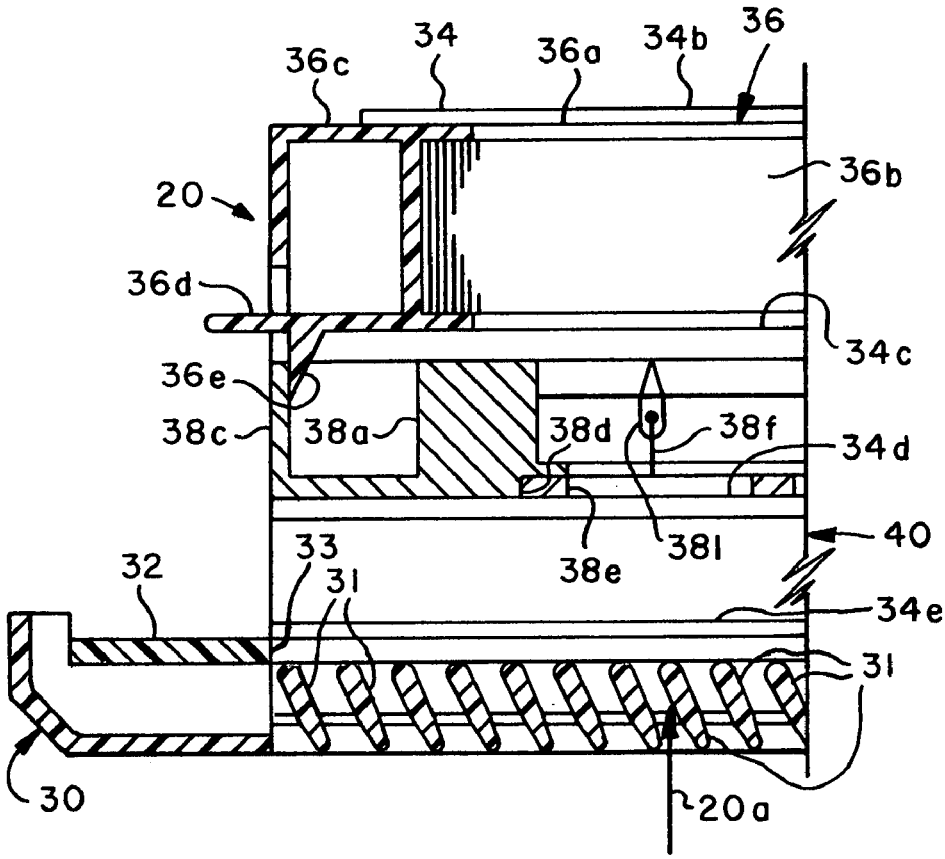
FIG. 4 is a detail section view taken generally along the line 4-4 of FIG. 3.
Figure 5:
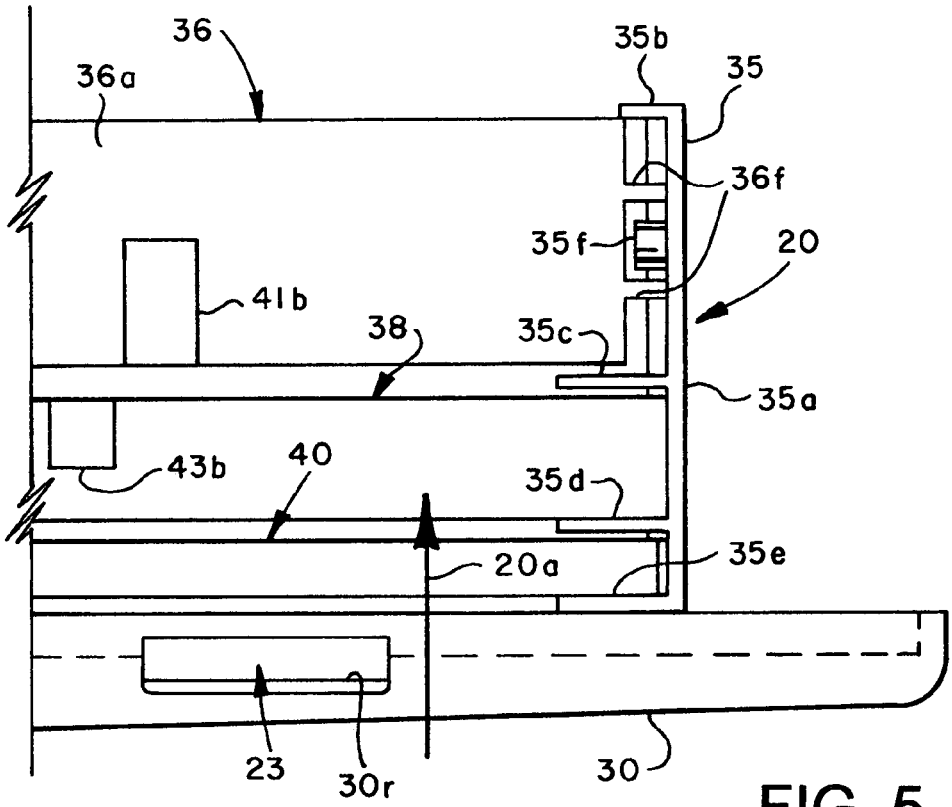
FIG. 5 is a detail view illustrating certain features of the system door and how components of the system are supported thereby.

The filtration system 20 is advantageously disposed at the inlet of a return air duct 21, FIG. 1, and the direction of airflow through the components of system is as indicated by the arrows 20*a* in FIGS. 1, 4 and 5. As shown in FIGS. 2 and 3, the frame or chassis 24 is preferably of a rectangular perimeter type including a perimeter flange 26 joined to top and bottom walls 24*a* and 24*b* and opposed sidewalls 24*c* and 24*d* and defining a substantial rectangular opening 25, FIG. 2. Chassis or frame 24 is preferably dimensioned to fit between wall supporting structural members or so called studs 27, FIG. 3. Suitable cross members, not shown, extending between the studs 27 may be provided to engage and support the top and bottom walls 24*a* and 24*b* of frame 24. The frame 24 may be suitably secured to the wall 22 at the structural members 27 using conventional fasteners extending through the walls 24*c* and 24*d* as well as the top and bottom walls 24*a* and 24*b*.

Referring further to FIGS. 2 and 3, the air filtration system 20 includes a door 32 which may be integrally formed with or separable from a grille 30 having a substantial number of closely spaced apart generally horizontally extending louvers 31, FIGS. 1 and 4, formed thereon and allowing air to flow therethrough. Alternatively, the louvers 31 may extend vertically or be replaced by other means forming openings, such as spaced apart holes. Door 32 is suitably hinged to the frame 24 at flange 26 by spaced apart hinges 29, see FIG. 7, for movement between a closed working position shown in FIG. 1 and the non working door open positions shown in FIGS. 2, 3 and 7, for example.

Door 32 includes a rectangular opening 33 formed therein. Grille 30 may be secured to door 32 by suitable snap fit features, not shown, or by conventional fasteners, if desired. Door 32 supports and may be integrally formed with opposed spaced apart parallel somewhat channel shaped support members, or brackets, 34 and 35, FIGS. 2, 3 and 7, which are adapted to support three major filter components including a main, electrically powered, filter unit 36, an electrically powered element generally known as a field charging unit 38, and a pre-filter 40, which may be a conventional impingement type air filter. Moreover, the filter unit 36 and the field charging unit 38 may be constructed substantially like the corresponding filter unit and field charging unit disclosed in U.S. Patent Application Publication No. US 2007/0039472 A1. The filter unit 36 and the field charging unit 38 may also embody features of the corresponding elements disclosed in U.S. Pat. No. 6,749,669.

Although the field charging unit 38 is constructed substantially like that described in Patent Application Publication No. US2007/0039472 A1, certain improvements have been developed with respect to certain components of the field charging unit. As described also in the aforementioned Patent Application Publication, the field charging unit 38 includes a frame 38*a* having a handle 38*c* formed thereon. Frame 38*a* supports a so called earth plate 38*d*, FIG. 4, and provided with plural spaced apart openings 38*e*, one shown in FIG. 4. An array of conductor pins 38*f*, one shown in FIG. 4, is mounted on frame 38*a* disposed such that a pin 38*f* is aligned with each of the openings or holes 38*e*.

Figure 4B:
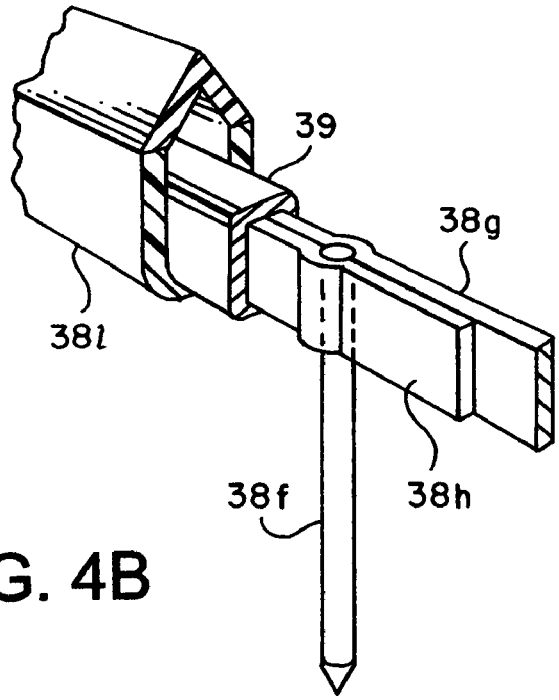
FIG. 4B is a detail perspective view of a charging pin for the field charging unit.

Conductor pins 38*f* are preferably formed of a tungsten composition and are secured to respectively elongated conductor bars 38*g*, a portion of one shown in FIG. 4B. Each pin 38*f* may be secured to a conductor bar 38*g* by short clamp member 38*h* by suitable means, such as spot welding operations, for example. Still further, it is desirable to minimize electrical arcing by and corrosion of the conductors of the field charging unit by encapsulating the conductor bars 38*g* with a suitable coating, such as a high voltage insulating polymer, for example, and indicated by numeral 39 in FIG. 4B. As further shown in FIG. 4B, a portion of one of the grid members of a supporting grid 38*l* is illustrated and which is operable to support the aforementioned spaced apart pins 38*f* generally in the manner described in the aforementioned Patent Application Publication. Alternatively, pins 38*f* may be embedded in a conductive polymer member taking the place of components 38*g* and 38*h* and encapsulated by a nonconductive polymer structure taking the place of parts 38*l* and 39, for example.

Figure 7:
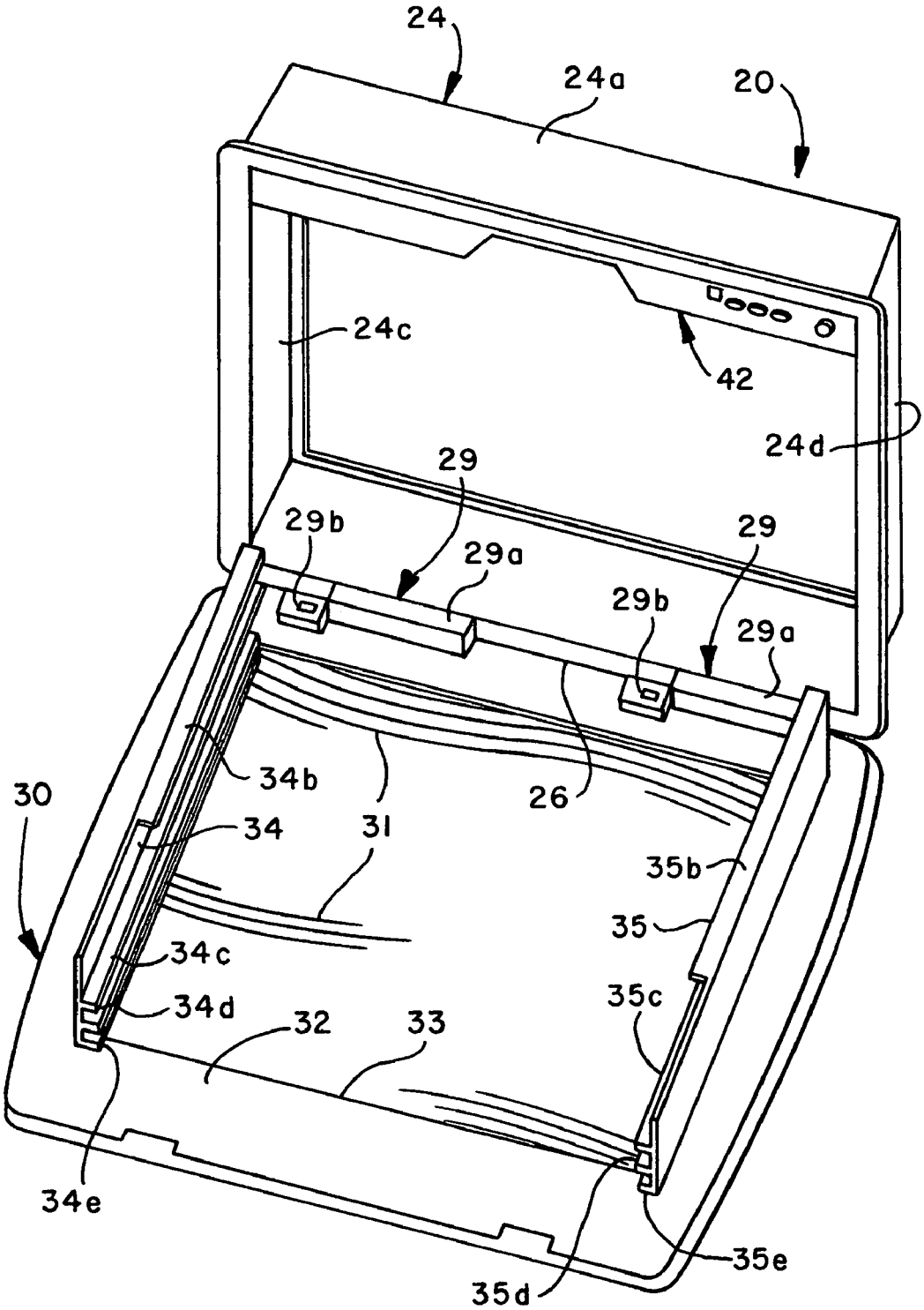
FIG. 7 is a perspective view similar in some respects to FIGS. 1 and 3 with the field charging unit and filter units removed for illustration of their support structure and the door hinges.
Figure 8:
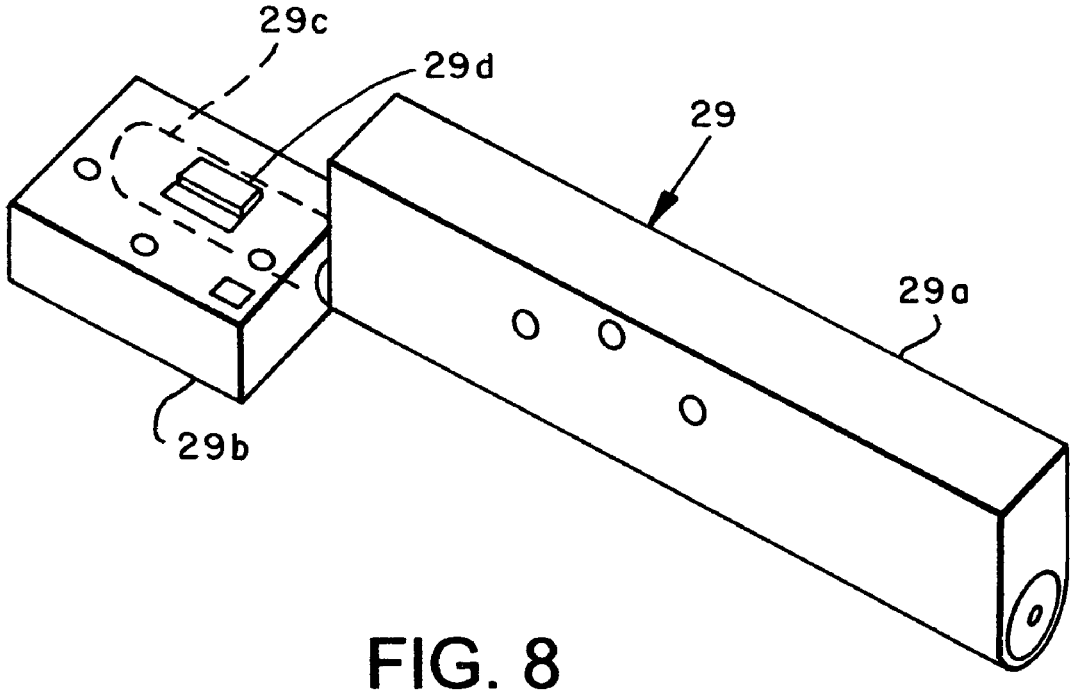
FIG. 8 is a detail perspective view of one of the door hinges shown in FIG. 7.

Referring briefly to FIGS. 7 and 8, the hinges 29 are adapted to provide for at least partially counterbalancing the weight of the door 32 or providing sufficient friction to enable opening of the door 32 without the weight of the door impairing operations to service the components supported on the door, such as filter units 36 and 40 and charging unit 38. This is particularly advantageous for filter units 20 which are mounted in a ceiling so that when the door 32 is opened it does not drop rapidly to the fully open position. In this regard, each of the hinges 29 includes a first hinge part 29*a* adapted to be suitably secured to the perimeter flange 26 of frame 24 and a second hinge part 29*b* suitably secured to the door 32. A hinge pin part 29*c*, FIG. 8, projects from hinge part 29*a* into a suitable bore in hinge part 29*b* and is slidably retained therein by a digitally actuatable latch part 29*d*. Actuation of the respective latch parts 29*d* enable separation of the hinge parts 29*b* from hinge parts 29*a* so that the door 32 may be moved with respect to the frame 24 by sliding the door to the left, viewing FIG. 7, whereby the hinge parts 29*a* and 29*b* become disengaged for complete removal of the door 32 from the frame 24, when desired. Alternatively, the hinges 29 may be oriented to allow door 32 to be disconnected from frame 24 by moving the door to the right, viewing FIG. 7. As mentioned previously, hinges 29 may be provided such that when the hinge parts 29*b* are rotated relative to the hinge parts 29*a* sufficient friction or a counterbalancing force is exerted by each hinge to retard or control movement of the door 32. Hinges 29 may be of a type commercially available, such as from the Reell Precision Manufacturing Corporation, St. Paul, Minn.

Figure 9:
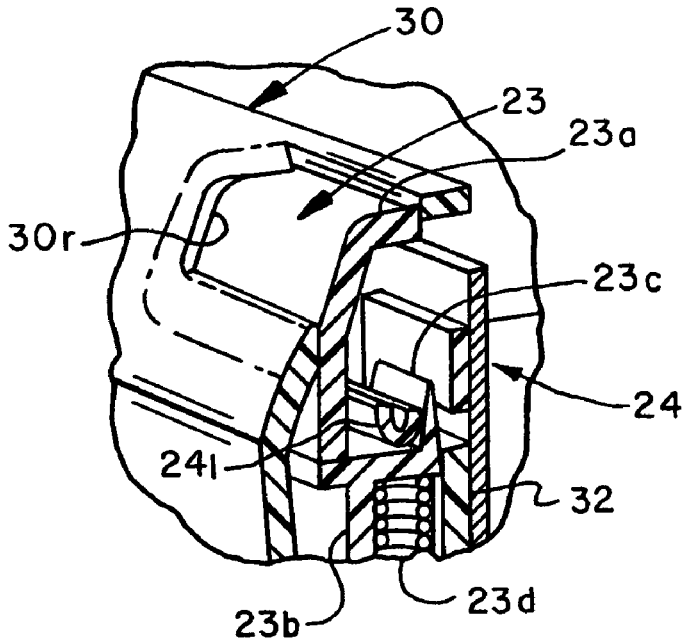
FIG. 9 is a detail view illustrating one of the latch mechanisms used to hold the door and grille in a closed position.

Door 32 is maintained in a so called closed position with respect to chassis or frame 24 by respective digitally actuatable latches 23, FIGS. 1 and 9. Grille 30 is provided with spaced apart openings or recesses 30*r*, see FIG. 9, by way of example, at which a digitally actuatable latch member 23*a* is disposed and may be depressed downward, viewing FIG. 9, to engage and move a latch member 23*b* so that a latch finger 23*c* secured thereto disengages from a latch hook 24 suitably mounted on frame 24. Latch member 23*b* is biased into the position for engagement of the finger 23*c* with the hook member 24*l* by a suitable coil spring 23*d* supported by door 32. FIG. 9 is exemplary of both of the latches 23 and in response to digital actuation of both latches the door 32 may be pivoted with respect to the frame 24 between closed and open positions.

Figure 9A:
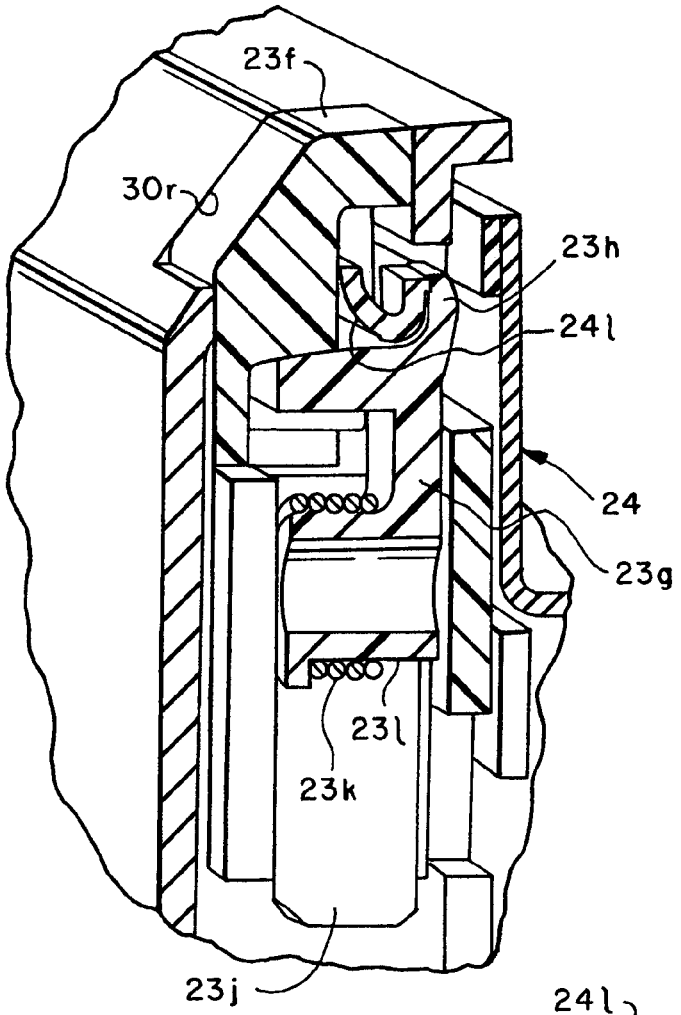
FIG. 9A is a detail view of an alternate embodiment of a latch mechanism for the door and grille.
Figure 9B:
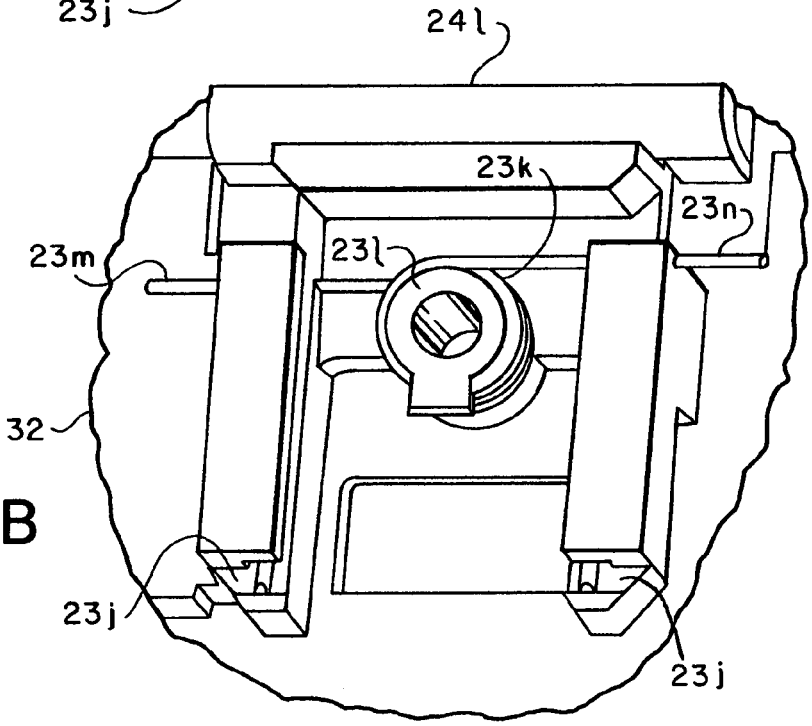
FIG. 9B is another detail view of the latch mechanism shown in FIG. 9A.

Referring to FIGS. 9A and 9B, an alternate embodiment of a latch mechanism for maintaining the door 32 in a closed position is illustrated. The latch mechanism illustrated in FIGS. 9A and 9B is similar in some respects to the latch 23 but includes a modified digitally actuatable latch member 23*f* engageable with a latch member 23*g* including a finger 23*h*. Latch member 23*g* includes spaced apart downwardly projecting legs 23*j* disposed for sliding engagement with the door 32. A torsion coil spring 23*k* is mounted on a hub 23*l* of latch member 23*g* and includes opposed tines 23*m* and 23*n* engageable with door 32 to bias the latch member into the latching position shown in FIG. 9A. However, in response to digital actuation of latch member 23*f*, latch member 23*g* is moved downwardly, viewing FIGS. 9A and 9B, against the bias of spring 23*k* to allow the door to be released from its closed position with respect to the chassis or frame 24.

Figure 6:
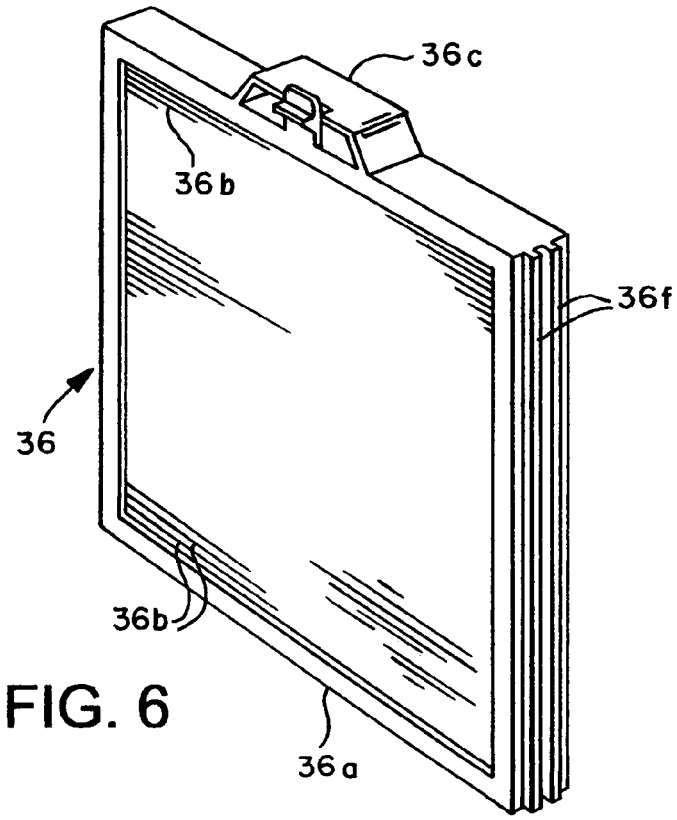
FIG. 6 is a perspective view of the primary or main electrically charged filter unit in accordance with the invention.

The main filter unit 36 is characterized by a generally rectangular perimeter frame 36*a*, see FIG. 6, supporting stacked filter elements like those disclosed in Patent Application Publication No. US 2007/0039472 A1 and designated by numeral 36*b* in FIGS. 2, 3 and 6. Frame 36*a* of filter unit 36 includes a handle part 36*c* for use in moving the filter unit into and out of the slot formed by the frame members 34 and 35, said slot being formed by flanges 34*b* and 34*c*, see FIG. 4, and 35*b* and 35*c*, see FIGS. 5, and 7 also. A deflectable latch member 36*d*, FIG. 4, includes a latch projection 36*e* engageable with a flange or wall forming the handle 38*c* of field charging unit 38, as shown. Accordingly, filter unit 36 may be retained on the door 32 by latching the filter unit to the field charging unit 38 which is suitably retained in a slot formed by the members 34 and 35 and delimited by the flanges 34*c*, 34*d*, 35*c* and 35*d*, see FIGS. 4, 5 and 7.

Figure 4A:
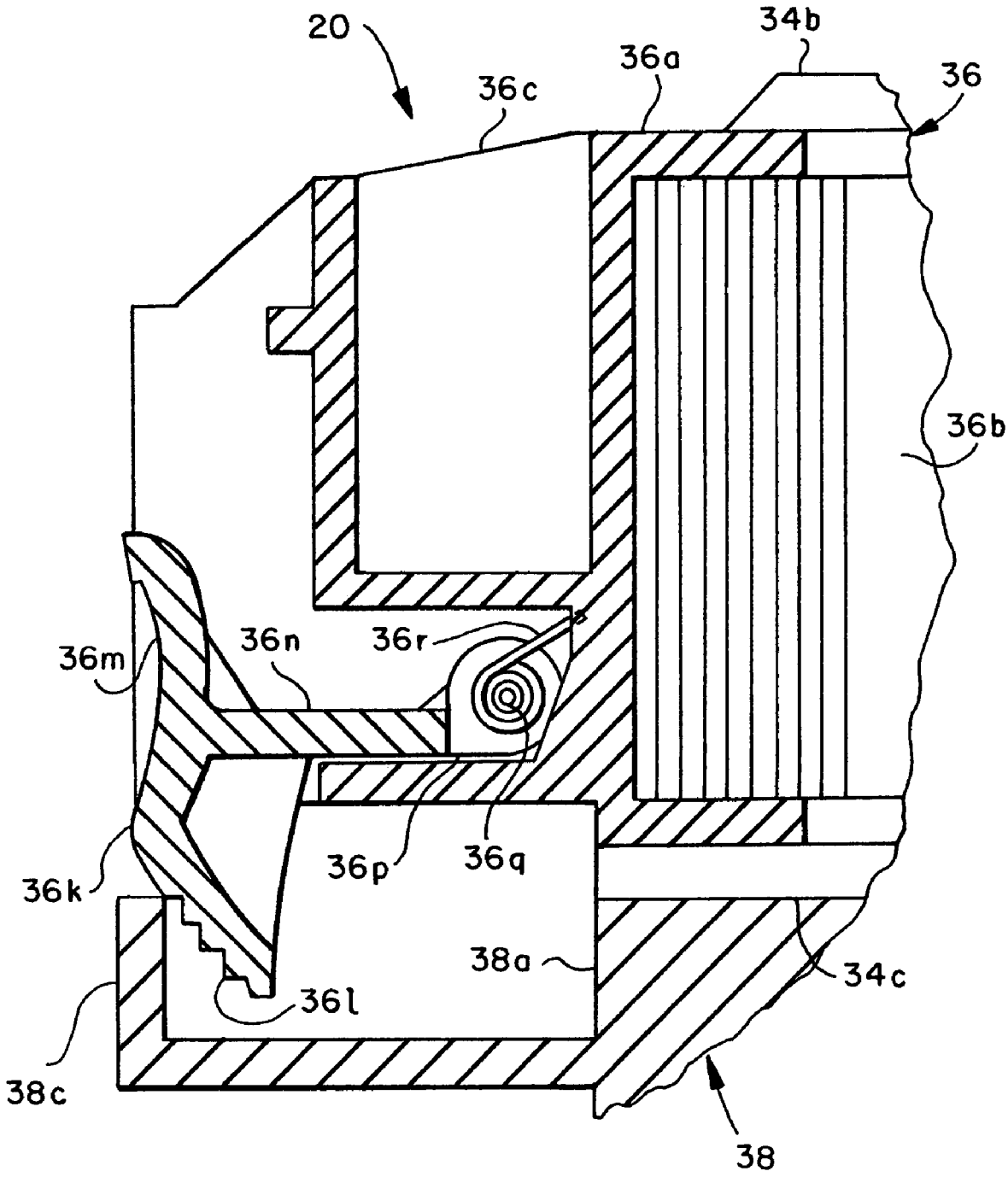
FIG. 4A is a detail section view taken along the same line as FIG. 4 showing an alternate embodiment of a latch mechanism.

Referring briefly to FIG. 4A, an alternate embodiment of a latch for latching the filter unit 36 in its working position engaged with the field charging unit 38 is illustrated. As shown in FIG. 4A, a digitally actuatable latch member 36*k* includes a stepped latch part 36*l* and a digitally actuatable or engageable part 36*m* which parts extend in opposite directions from a web part 36*n*. The base of web part 36*n* includes a boss 36*p* which is supported for pivotal movement about a pivot pin 36*q* and is biased into the latching position shown by a torsion coil spring 36*r*. Accordingly, latch member 36*k* engages the flange forming handle 38*c* of field charging unit 38 in generally the same manner as provided for by the latch 36*d*, 36*e*.

As shown in FIGS. 5 and 6, filter unit frame 36 includes spaced apart elongated projections 36*f* extending along one side of the frame and operable to receive a boss 35*f*, FIG. 5, slidably therebetween so that the filter unit 36 may not be placed between the support members or brackets 34 and 35 incorrectly. Frame 36*a* is thus dimensioned such that it may not be placed inverted with respect to door 32, thanks to the parallel projections 36*f* and boss 35*f*. Viewing FIG. 3, spaced apart electrical contact members 41*a* and 41*b* are provided on filter unit frame 36*a* and are polarity sensitive. Accordingly, the filter unit 36 is required to be oriented in a pre-determined position, as shown in the drawings, and should not be reversed or placed between the members 34 and 35 upside down. The aforementioned pre-filter 40 is also operable to be disposed between the brackets 34 and 35 and suitably supported thereby between flanges 34*d* and 34*e*, and between the flanges 35*d* and 35*e*, FIGS. 4, and 5.

Figure 10:
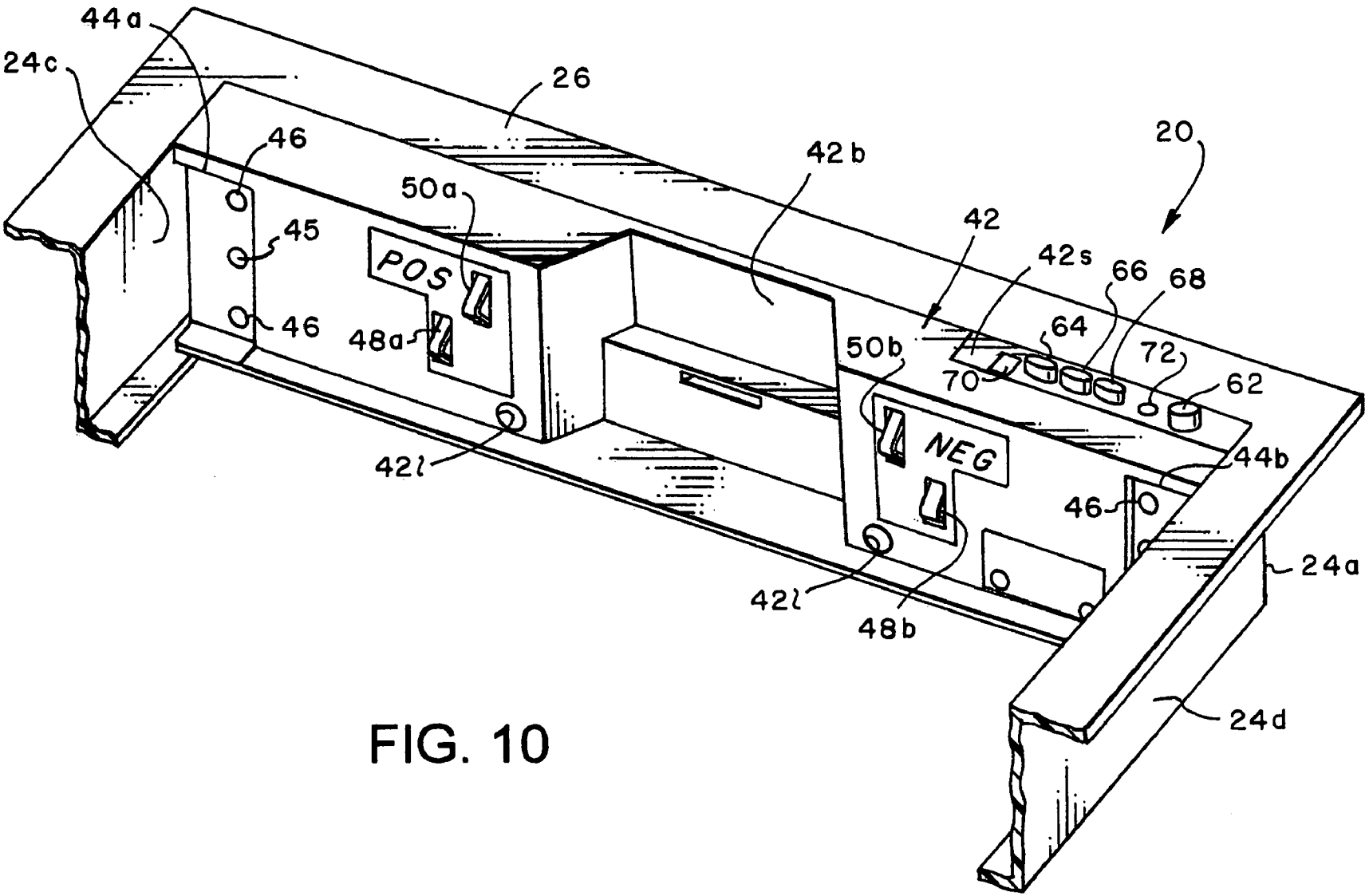
FIG. 10 is a perspective view of the control box or enclosure for the system of the present invention.

As shown in FIGS. 2 and 3, field charging unit 38 is also provided with spaced apart electrical contact members 43*a* and 43*b* which are polarity sensitive and are disposed, together with the contact members 41*a* and 41*b*, in predetermined positions for engagement with corresponding contact members disposed on a control box or enclosure, generally designated by the numeral 42, see FIGS. 2, 3 and 10, for example. Control enclosure 42 is mounted on frame 24 between sidewalls 24*c* and 24*d* and preferably contiguous with wall 24*a*. Suitable brackets 44*a* and 44*b*, FIG. 10, are supported on or formed integral with opposed sidewalls 24*c* and 24*d* for supporting control enclosure 42, as shown. Each of brackets 44*a* and 44*b* may be provided with suitable detent means 45, one shown, for engagement with a corresponding projection on control enclosure 42 to assist in supporting the control enclosure when removable fasteners 46, for example, are being secured to or removed from the control enclosure.

Control enclosure 42 includes spaced apart electrical contact elements 48*a*, 48*b*, 50*a* and 50*b* suitably supported thereon as will be explained in further detail herein. Contact elements 48*a*, 48*b*, 50*a* and 50*b* are elastically deflectable and are engageable with corresponding contact elements on the filter unit 36 and the field charging unit 38. Accordingly, when the door 30 is moved to a closed position, as shown in FIG. 1, contact element 48*a* engages contact member 41*a*, FIG. 3, contact element 50*a* engages contact member 43*a*, contact element 48*b* engages contact member 41*b*, and contact element 50*b* engages contact member 43*b*. As indicated in FIG. 10, the contact elements 48*a*, 50*a*, 48*b* and 50*b* are marked with the appropriate polarity markings. Thus, when door 32 is moved between the position shown in FIG. 1 and a door open position, electric power to the filter unit 36 and the field charging unit 38 is interrupted. Still further, as will be described hereinbelow, electrical power is also cut off with respect to the contact elements 48*a*, 48*b*, 50*a* and 50*b* mounted on the control box or enclosure 42 so that these contact elements are de-energized.

Figure 13:
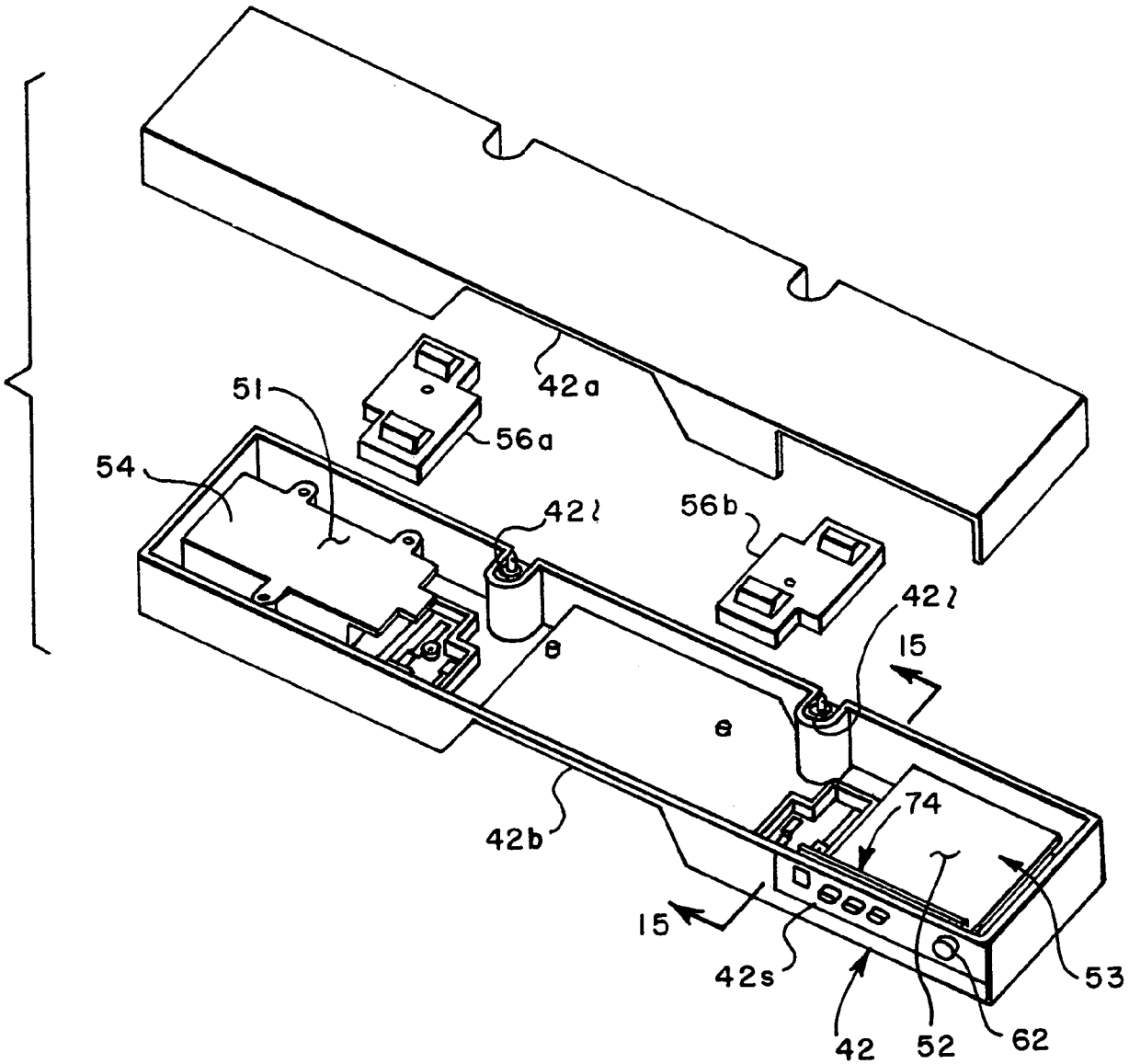
FIG. 13 is an exploded perspective view of the control box or enclosure for the control system for the present invention.
Figure 14:
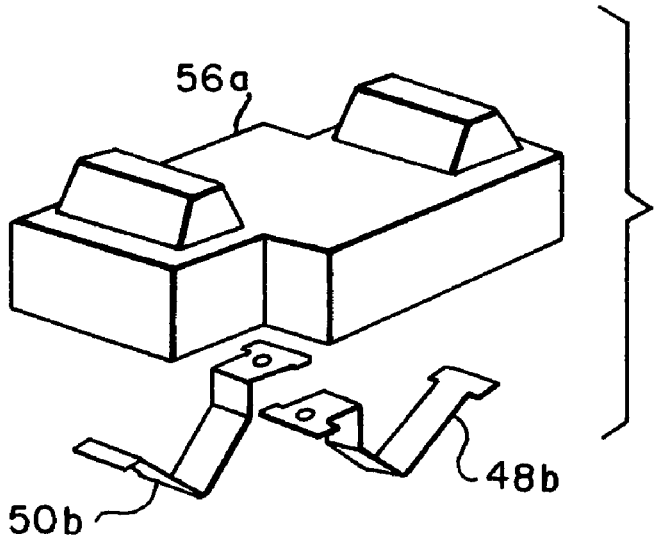
FIG. 14 is a detail exploded perspective view of one of the contact element support brackets or covers for supporting two of the four required contact elements for the system of the invention.
Figure 15:
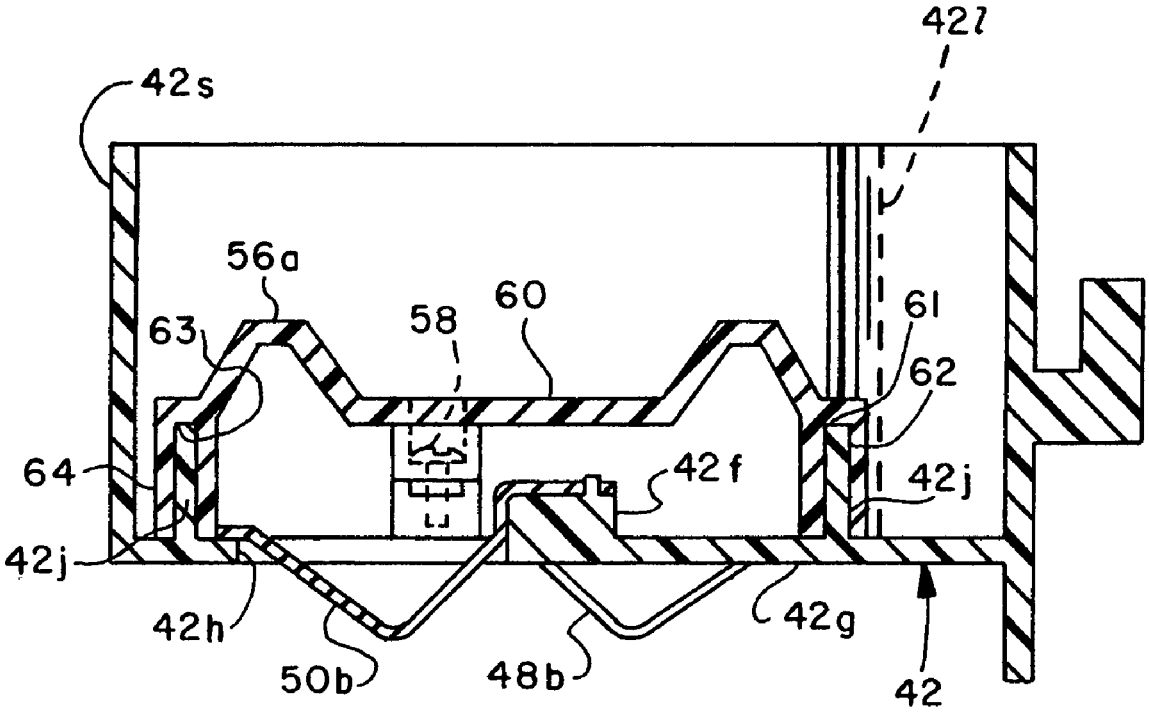
FIG. 15 is detail composite section view taken generally along the line 15-15 of FIG. 13.

Referring now to FIGS. 13, 14 and 15, control enclosure 42 includes opposed sections defining spaced apart enclosure spaces 51 and 52 for receiving certain electrical components of the controls for the system 20, including a circuit board 53 and a power supply or transformer 54. Suitable heat sinks, not shown, may be disposed in space 51 also for maintaining a suitable operating temperature for power supply 54. A suitable cover 42*a* is operable to cover the enclosure 42 including the spaces 51 and 52. Enclosure 42 includes an intermediate recessed portion 42*b* forming a chase, FIG. 13, to provide clearance for handle portions 36*c* and 38*c*, FIG. 3, of the filter unit 36 and field charging unit 38 when the door 32 is moved to a closed position. Enclosure 42 may be formed in multiple parts suitably secured together by intermediate section 42*b*.

Contact elements 48*a*, 48*b*, 50*a* and 50*b* are supported on control enclosure 42 in a manner as illustrated in FIGS. 13 through 15. By way of example, viewing FIG. 15, contact elements or members 48*b* and 50*b* are suitably supported on enclosure 42 by respective bosses 42*f*, one shown, formed integral with an enclosure bottom wall 42*g*, FIG. 15, whereby contact member 50*b* is shown supported by a boss 42*f*, by way of example, and projecting through a slot 42*h* in wall 42*g* to assume the working position illustrated in FIG. 10. Contact elements 48*b*, 50*a* and 48*a* are supported in a manner virtually identical to that illustrated in FIG. 15. Each pair of contact elements 48*a*, 50*a* and 48*b*, 50*b* is also protected by respective removable covers 56*a*, and 56*b*, FIGS. 13 through 15. Covers 56*a* and 56*b* are mirror image parts or are otherwise configured to prevent misplacement and are each retained in engagement with enclosure 42 by suitable fasteners, such as machine screws 58, one shown in FIG. 15 for cover 56*a*.

As shown by example in FIG. 15, covers 56*a* and 56*b* are each also provided with a top wall 60 and spaced apart depending endwalls 61, 62 and 63, 64, which fit over upstanding fins 42*j* as shown. This arrangement of the covers 56*a* and 56*b* and the fins 42*j* provides isolation of electrical charges imposed on the contact elements 48*a*, 50*a*, 48*b* and 50*b* from other control components. FIG. 15 is a composite section view illustrating the manner in which each of the contact elements 48*a*, 48*b*, 50*a* and 50*b* is supported on the enclosure 42 and how these elements are covered by the contact element covers 56*a* and 56*b*. Suitable clearance holes 42*l* may be provided in the enclosure 42 for receiving fasteners which may be used to secure the frame 24 to a suitable cross member, not shown, forming part of wall framing for receiving and supporting the frame 24.

Figure 16:
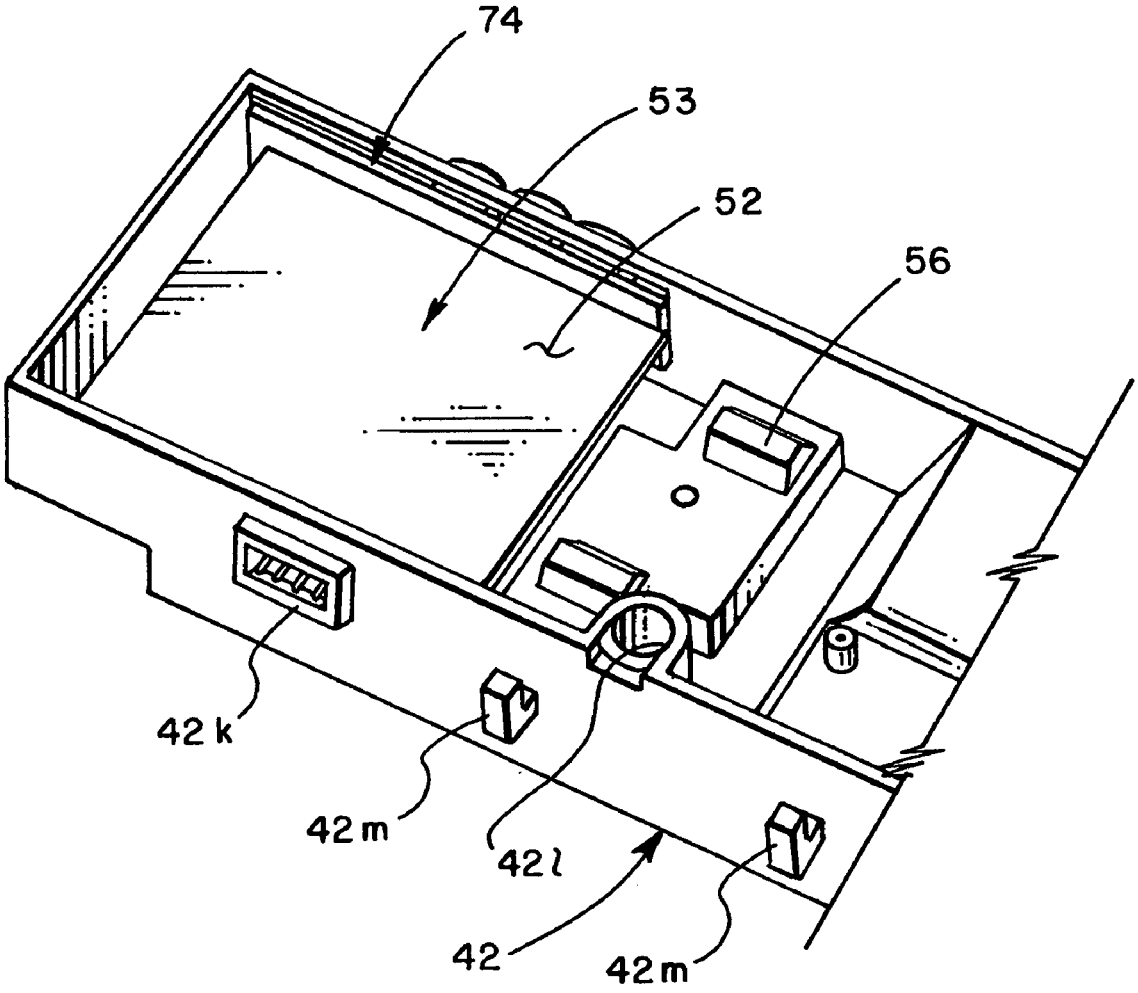
FIG. 16 is another detail perspective view of the control system enclosure illustrating certain features thereof.

As shown in FIG. 16, control enclosure 42 includes a suitable electrical connector part 42*k* supported thereon for connection to a source of electrical power not shown for the filter unit 20. Respective, spaced apart integrally molded hooks 42*m* may be provided on enclosure 42, as illustrated in FIG. 16, for training electrical conductors along one side of the enclosure 42 to minimize the chance of such conductors dangling in the flow path of air flowing through the return air duct 21 when the filtration system 20 is installed in its working position shown in FIG. 1.

Figure 11:
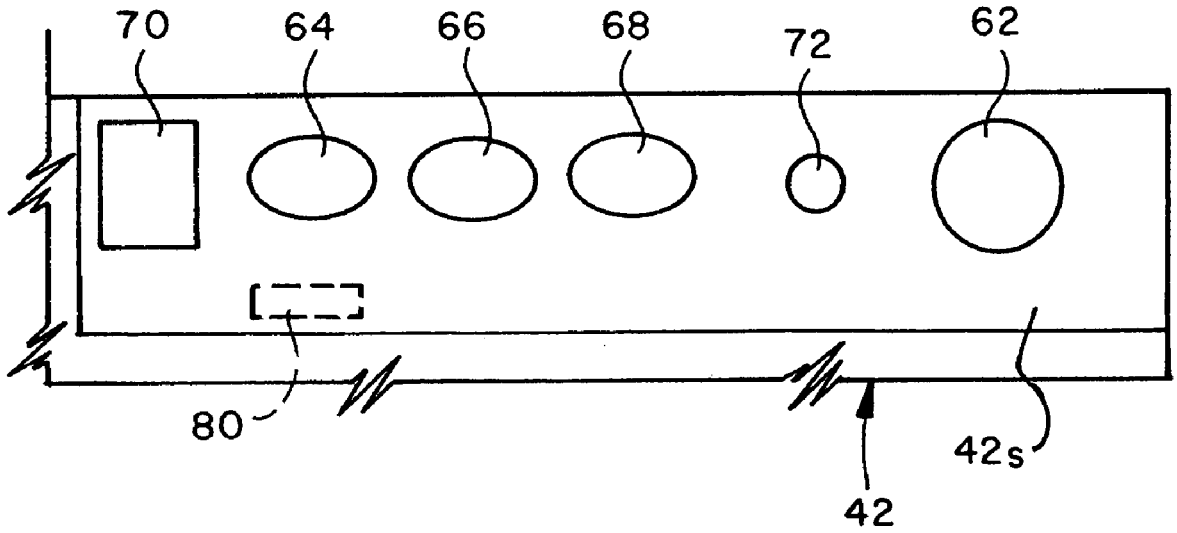
FIG. 11 is a detail front elevation of a user interface or control panel.
Figure 12:
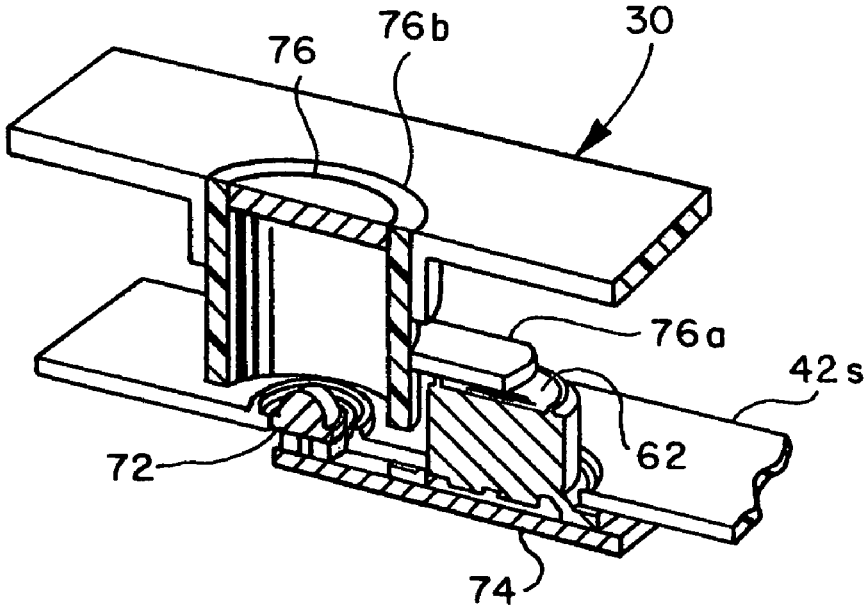
FIG. 12 is a detail cutaway view showing the relationship between a user actuatable system start and stop switch and lighting therefor.

Referring now to FIGS. 10 and 11, the control enclosure 42 is adapted to support user operable control switches including a main power on-off switch 62 and additional switches 64, 66 and 68 which project through suitable openings in enclosure wall portion 42*s*. Switches 64, 66 and 68 are, for example, operable for inputting selected control operating features, such as for selecting a minimum or maximum high voltage condition, a reminder to service or change the pre-filter 40 and a reminder to service the filter unit 36, for example. A seven segment visual display 70 is also provided for use in selecting the above-mentioned parameters. Still further, a visual indicator 72 is provided to indicate the status of the filtration system 20, that is, on versus off and/or a need to service the system 20. The switches 62, 64, 66, 68, the display 70 and the indicator 72 may be mounted on a so called daughter control board 74, FIGS. 13 and 16, supported within the enclosure 42 and adjacent wall portion 42*s*. Suitable elastomeric buttons, not shown, may cover the switches 62, 64, 66 and 68 to prevent unwanted contact with control board 74. As shown in FIGS. 1 and 12, an actuator 76 for the switch 62 is supported by the grille 30, as indicated, and includes an arm 76*a* engageable with the switch 62, see FIG. 12, when door 32 is in the closed working position. Actuator 76 is preferably formed of a somewhat resilient electrically nonconductive material. As further shown in FIG. 12, switch actuator 76 includes a translucent curvilinear rim part 76*b* which is operable to transmit light from the visual indicator 72 therethrough for observation by a user of the filtration system 20 without opening the door 32. Accordingly, a user of the filtration system 20 may energize and de-energize the system without opening door 32, observe whether power is being supplied to the system and/or observe if there is a need to service the system.

Referring further to FIG. 11, the control system for the filtration system 20 includes a so called interlock which de-energizes the system when the door 32 is moved from a closed position, as shown in FIG. 1, to an open position. A preferred embodiment of the interlock includes a reed switch 80, FIGS. 11 and 17, preferably mounted adjacent to or on the daughter control board 74 or on or adjacent to circuit board 53. The reed switch 80 is in proximity to a magnet 82, FIG. 3, when the door 32 is in the closed position, which magnet may be mounted on the door 32. Accordingly, when the door 32 is moved from its closed position, as shown in FIG. 1, to an open position, as shown in FIGS. 2 and 3, magnet 82 moves out of range of the reed switch 80 thereby causing the reed switch to open and interrupt power to the filtration system 20. Alternatively, the magnet 82 may be mounted on the grille 30 in the same general location such that, when door 32 or the grille alone is moved, reed switch 82 will open.

Figure 17:
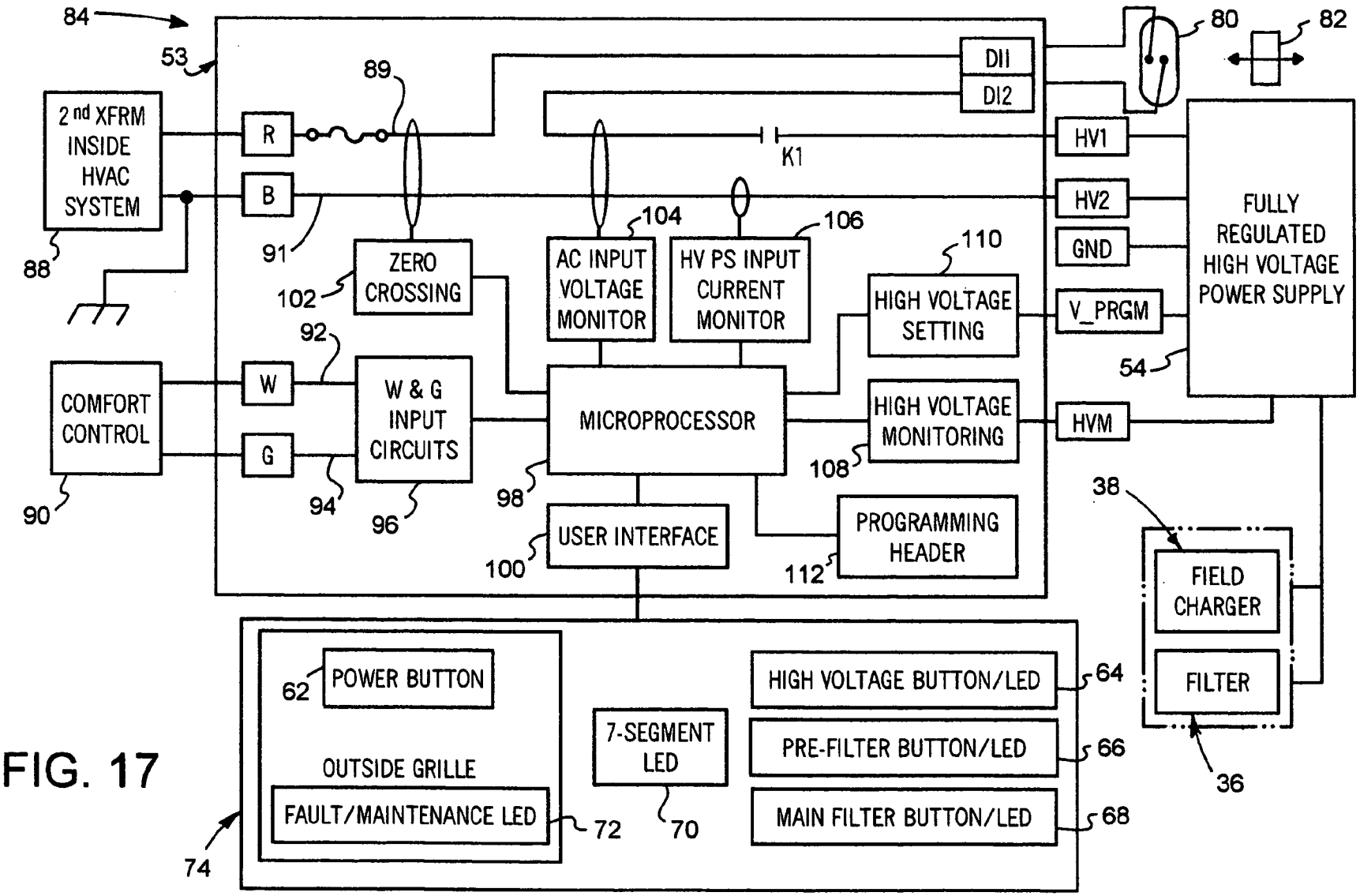
FIG. 17 is a schematic block diagram of the control system for the air filtration system of the invention.

Referring now to FIG. 17, there is illustrated a schematic block diagram of a control system 84 for the filtration system 20, including the circuit board 53, the power supply 54, and the daughter board 74. Visual indicator 72 is shown mounted on board 74 in the diagram of FIG. 17, as well as switch 62, the display 70 and the switches 64, 66 and 68. Power for the control system 84 is typically received from an external 24 volt AC transformer connected to or associated with a unit of air conditioning equipment with which the return air duct 21 is associated. A power source, such as a transformer 88, is indicated schematically in FIG. 17. The control system 84 is also adapted to receive control signals from a thermostat or other control circuit 90 associated with the aforementioned air conditioning apparatus such that, when a call for "heat", or "cooling" or "fan only" is generated by the control circuit 90, signals are sent via conductors 92 or 94 to a conditioning circuit 96 which is connected to a suitable microprocessor 98 forming part of control system 84, as shown in FIG. 17.

Microprocessor 98 is connected to daughter circuit board 74 via a suitable signal conditioning and transmission interface circuit 100. Power input through the control circuit 84 is by way of transformer 88 and a fused conductor 89 and conductor 91 connected to power supply 54 by way of the aforementioned interlock which includes the reed switch 80 as shown in FIG. 17. As shown in FIG. 17, microprocessor 98 also receives input signals from a zero crossing sensor 102, an input voltage monitor 104, a high voltage power supply input current monitor 106, a high voltage monitor 108, a high voltage setting circuit 110 and a programming header 112. Regulated high voltage power is supplied by power supply unit 54 to the field charging unit 38 and the filter unit 36 by suitable electrical connections including the contact elements associated with the respective units and with the control box or enclosure 42, as described above. The control system 84 may be similar in some respects to the control system described in U.S. Patent Application Publication No. US2007/0039462 A1 by Helt et al., published Feb. 22, 2007, and assigned to the assignee of the present invention. The subject matter of Patent Application Publication No. US2007/0039462 A1 is also incorporated herein by reference.

Figure 18:
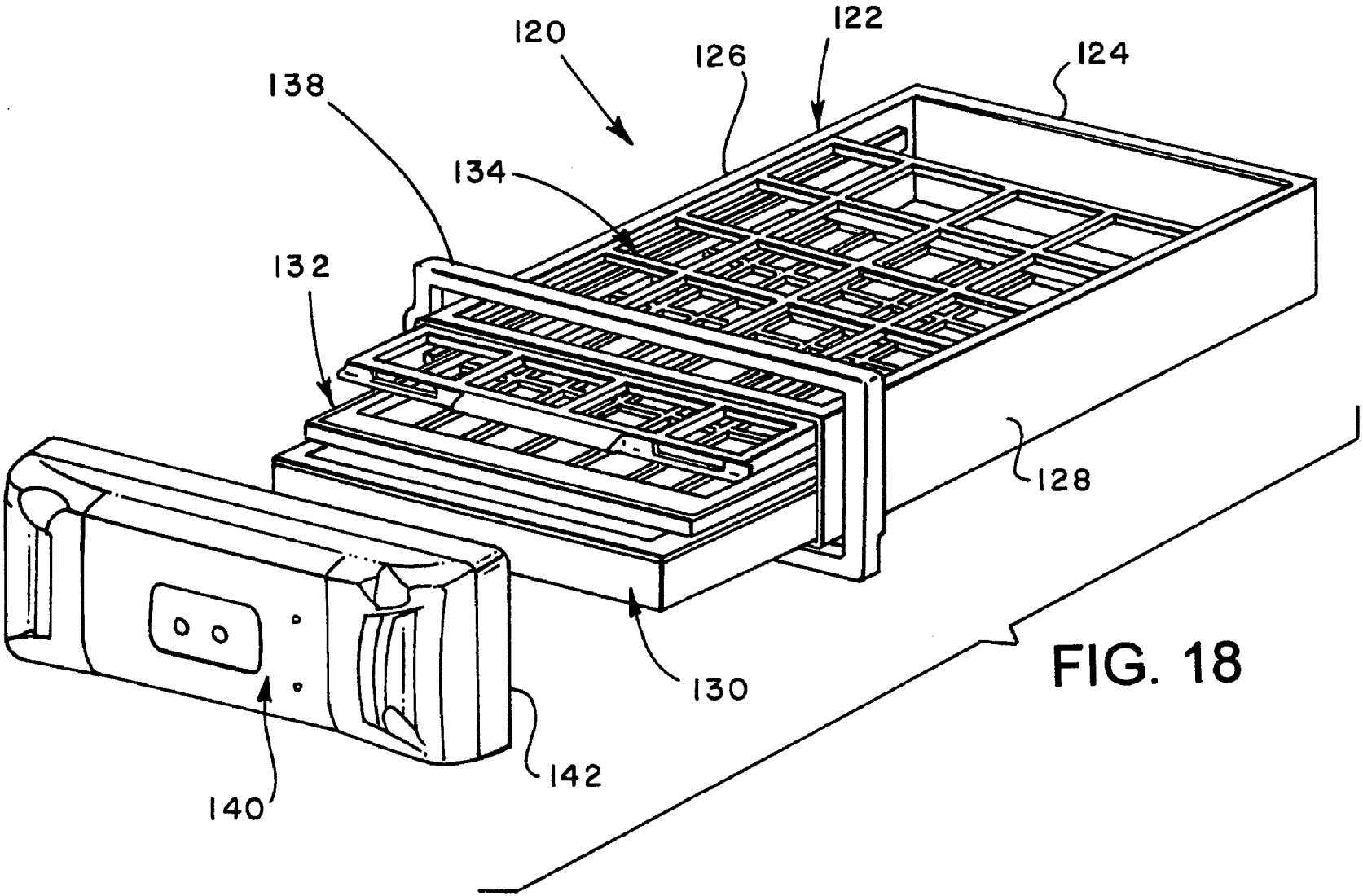
FIG. 18 is a perspective view of another embodiment of an air filtration system in accordance with the invention.
Figure 19:
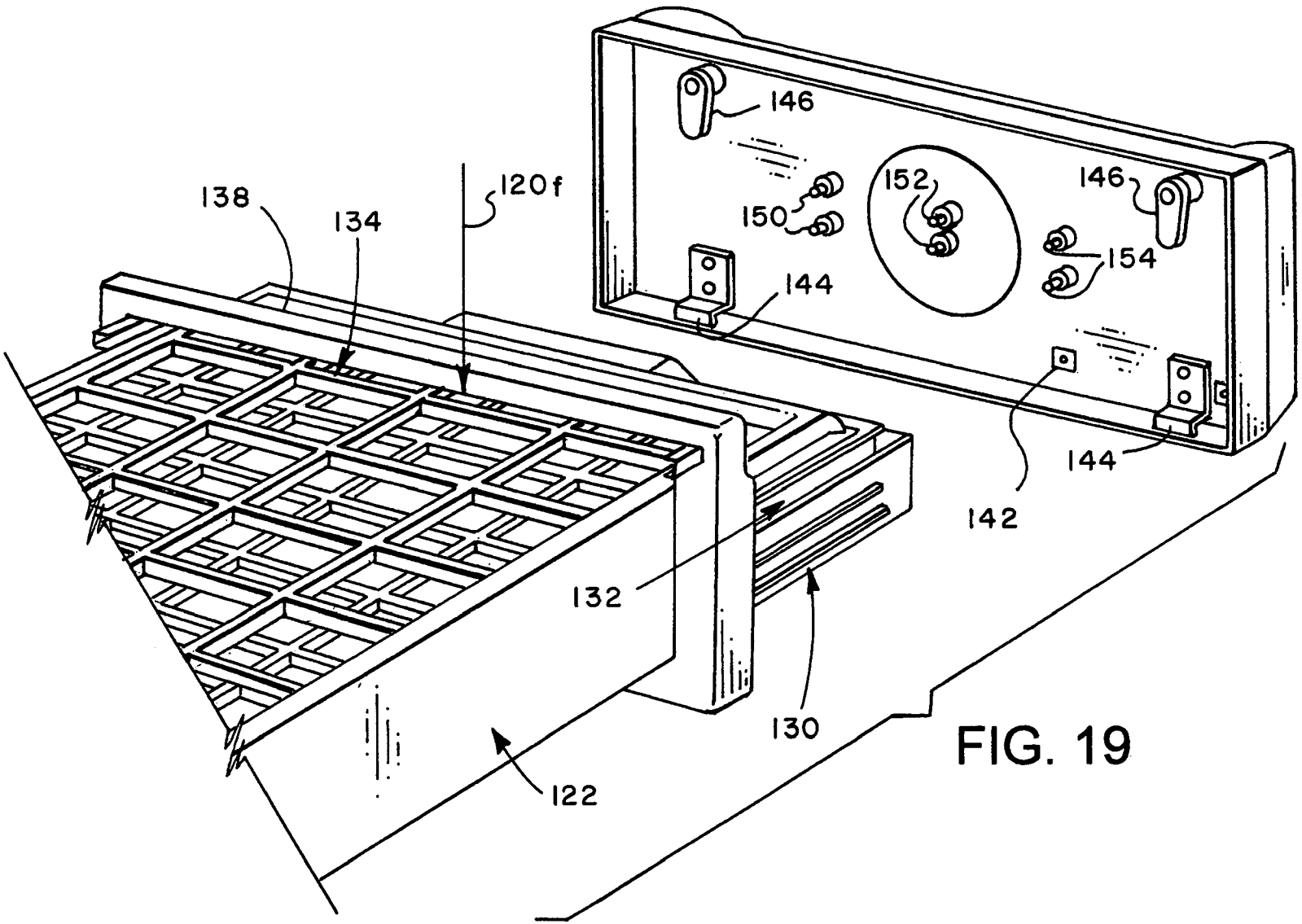
FIG. 19 is a perspective view of the system shown in FIG. 18 taken from a perspective opposite that of FIG. 18.

Referring now to FIGS. 18 and 19, another preferred embodiment of an air filtration system in accordance with the invention is illustrated and generally designated by the numeral 120. The filtration system 120 is similar in many respects to the system described in Patent Application Publications US2007/0039462 A1 and US2007/0039472 A1 identified hereinabove. The system 120 includes a support frame 122 characterized as a substantially u-shaped sheet metal member having a somewhat shallow channel shaped cross section and comprising a bottom wall 124 and opposed sidewalls 126 and 128. Sidewalls 126 and 128 are provided with suitable elongated parallel guiderails for supporting a primary or main filter unit 130 corresponding generally to the filter unit 36, a field charging unit 132 corresponding generally to the field charging unit 38 and a suitable pre-filter 134 corresponding to the pre-filter 40. Accordingly, the filter unit 130, the field charging unit 132, and the pre-filter 134 may be supported by the frame 122 in a manner substantially like that of the filter system 20. Frame 122 includes a perimeter frame member 138 suitably secured to the sidewalls 126 and 128 and adapted to support a door assembly 140 for retaining the filter unit 130, the field charging unit 132 and the pre-filter 134 in assembly with the frame 122.

Door assembly 140 includes a base plate 142 FIG. 19, including spaced apart retainer tabs 144 and rotatable latches 146 for releasably connecting the door to the perimeter frame 138. Spaced apart sets of electrical contact elements 150, 152 and 154 cooperate with the filter unit 130 and the field charging unit 132 in substantially the same manner as described in the aforementioned Patent Application Publications which are incorporated herein by reference. Door assembly 140 also comprises an enclosure for a control circuit and components thereof substantially like that illustrated in FIG. 17 or like that disclosed in Patent Application Publication US2007/0039462 A1. The filter system 120 is advantageous for retrofitting an improved filter system in accordance with the invention to ductwork and in locations other than an inlet to a return air duct, for example.

Preferred embodiments of the invention have been described herein in sufficient detail, it is believed, to enable one skilled in the art to practice the invention. Conventional engineering materials and practices may be used to construct the embodiments of the invention, except as otherwise described herein or in the documents which are incorporated herein by reference. Although preferred embodiments of the invention have been described in detail, those skilled in the art will also recognize that various substitutions and modifications may be made without departing from the scope and spirit of the appended claims.

What is claimed is:

1. An air filtration system for an air conditioning apparatus, said air filtration system comprising:

a frame adapted to be mounted at an inlet to an air duct, the frame comprising a control enclosure having a control enclosure wall having at least one control switch that is at least one of (1) at least partially carried within an aperture of the control enclosure wall and (2) carried within the control enclosure and accessible through the control enclosure wall;

a support member mounted on and for movement relative to said frame between a working position and a non-working position, said support member including an air inlet grille disposed thereon, wherein the air inlet grille obstructs access to the at least one control switch when the support member is in the working position and wherein the air inlet grille allows access to the at least one control switch when the support member is in the non-working position;

a filter unit mounted on said support member and operable to generate a high voltage electric field for collecting particles on said filter unit from an airflow stream flowing therethrough; and a high voltage electric field charging unit mounted on said support member upstream from said filter unit with respect to the direction of air flowing through said air filtration system.

2. The air filtration system set forth in claim 1 including: a pre-filter unit mounted on said support member upstream of said field charging unit.

3. The air filtration system set forth in claim 1 wherein: said support member comprises a door connected to said frame by hinge means for movement between said working position and said non-working position.

4. The air filtration system set forth in claim 3 wherein: said hinge means comprise spaced apart hinges including separable hinge members, respectively, whereby said door may be pivoted between said working and non-working positions with respect to said frame and removed from said frame.

5. The air filtration system set forth in claim 3 including: manually actuatable latches for latching said door in said working position and for releasing said door for movement to said non-working position.

6. The air filtration system according to claim 3, wherein said filter unit and said field charging unit include electrical contact members formed thereon and engageable with corresponding electrical contact members mounted on the control enclosure supported by said frame.

7. The air filtration system set forth in claim 6 wherein: said electrical contact members on said control enclosure are spaced apart in respective pairs of contact members and are operably connected to a source of high voltage electric potential.

8. The air filtration system set forth in claim 7 including: insulated cover members disposed on said enclosure and covering said electrical contact members.

9. The air filtration system set forth in claim 7 wherein: said cover members include at least spaced apart double walls formed thereon providing electrical isolation from said electrical contact members.

10. The air filtration system according to claim 1, wherein the control enclosure at least partially houses a control circuit and a high voltage power supply for supplying high voltage electric potential to said filter unit and said field charging unit.

11. The air filtration system according to claim 1, wherein operation of the at least one control switch is configured to set a high voltage limit of the air filtration system.

12. The air filtration system according to claim 10, further comprising: an interlock associated with said control circuit for interrupting power to said power supply when said support member is moved from said working position to the non-working position.

13. The air filtration system set forth in claim 12 wherein: said interlock includes a reed switch associated with said control circuit and a magnet supported by said support member for actuating said reed switch.

14. The air filtration system set forth in claim 10, further comprising: a switch actuator supported by said support member for engagement with the at least one control switch, wherein the at least one control switch is configured to selectively control energizing and de-energizing said air filtration system.

15. The air filtration system set forth in claim 10 including: spaced apart brackets for supporting said enclosure on said frame between opposed sidewalls and between top and bottom walls of said frame.

16. The air filtration system set forth in claim 1 wherein: said filter unit includes a latch member supported thereon and engageable with a cooperating latch member fixed with respect to said support member whereby said filter unit may be releasably retained on said support member.

17. The air filtration system set forth in claim 1 wherein: said support member comprises spaced apart bracket members forming respective parallel slots for receiving said filter unit and said field charging unit to be disposed directly adjacent each other.

18. The air filtration system set forth in claim 17 wherein: at least one of said bracket members includes means cooperable with said filter unit to prevent placing said filter unit on said support member in any but a predetermined working position of said filter unit.

19. The air filtration system set forth in claim 1 wherein: the filter unit comprises an array of passages through which the airflow stream may pass relatively free and through a high voltage electric field for collecting particles on said filter unit from said airflow stream.

20. The air filtration system set forth in claim 1 wherein: the air inlet grille comprises:

a plurality of substantially horizontal louvers; and a plurality of substantially vertical louvers.

21. The air filtration system set forth in claim 1 wherein: the air inlet grille is configured for securing to the support member via a snap fit feature.

22. An air filtration system for an air conditioning apparatus, said air filtration system comprising:

a frame adapted to be mounted to an air duct;

a door connected to said frame by hinge means for movement relative to said frame between a working position and a non-working position, said door including an air inlet grille disposed thereon;

a filter unit mounted on said door and operable to generate a high voltage electric field for collecting particles on said filter unit from an airflow stream flowing therethrough;

a high voltage electric field charging unit disposed upstream from said filter unit with respect to the direction of air flowing through said air filtration system;

a control enclosure mounted on said frame, the control enclosure having a control enclosure wall having at least one control switch that is at least one of (1) at least partially carried within an aperture of the control enclosure wall and (2) accessible through the aperture in the control enclosure wall;

said filter unit and said field charging unit include electrical contact members formed thereon and engageable with corresponding electrical contact members on said control enclosure;

wherein the air inlet grille obstructs access to the at least one control switch when the door is in the working position and wherein the air inlet grille allows access to the at least one control switch when the door is in the non-working position.

23. The air filtration system set forth in claim 22 wherein: said hinge means comprise spaced apart hinges including separable hinge members, respectively, whereby said door may be pivoted between said working and non-working positions with respect to said frame and removed from said frame.

24. The air filtration system according to claim 22, further comprising: manually actuatable latches for latching said door in said working position and for releasing said door for movement to said non-working position.

25. The air filtration system according to claim 22, further comprising: a control circuit at least partially housed within the enclosure, the control circuit comprising a high voltage power supply for supplying high voltage electric potential to said filter unit and said field charging unit.

26. The air filtration system according to claim 22, further comprising: at least one of a visual display and a visual indicator associated with said enclosure, the at least one of the visual display and the visual indicator being configured to communicate a status of the air filtration system.

27. The air filtration system set forth in according to claim 26, wherein at least one of the visual display and the visual indicator is obscured from view when the door is in the working position and is less obscured from view when the door is in the non-working position.

28. The air filtration system set forth in claim 25 including: an interlock associated with said control circuit for interrupting power to said power supply when one of said door and said grille is moved from said working position to a non-working position.

29. The air filtration system set forth in claim 28 wherein: said interlock includes a reed switch associated with said control circuit and a magnet mounted on one of said door and said grille for actuating said reed switch.

30. The air filtration system according to claim 22, further comprising: a grille actuator at least partially carried by or accessible through the grille, the grille actuator being configured to selectively actuate the control switch.

31. The air filtration system set forth in claim 22 wherein: said door includes support members thereon for supporting said filter unit and said field charging unit on said door.

32. The air filtration system set forth in claim 31 wherein: said filter unit includes a latch member supported thereon and engageable with cooperating means fixed with respect to said door whereby said filter unit may be releasably retained on said door.

33. The air filtration system according to claim 30, wherein the grille actuator comprises at least one of (1) an arm configured to extend at least partially transverse to a direction of grille actuator movement and (2) a translucent portion, the arm being configured to selectively contact the control switch and the translucent portion being configured to transmit light from at least one of the visual display and the visual indicator.

* * * * *